US012650055B1

(12) United States Patent
Fripp et al.

(10) Patent No.: US 12,650,055 B1
(45) Date of Patent: Jun. 9, 2026

(54) VALVE SYSTEM WITH TEMPORARY SUPPORT FOR CONTROLLING FLOW OF FLUID IN A WELLBORE

(71) Applicant: Halliburton Energy Services, Inc., Houston, TX (US)

(72) Inventors: Michael Linley Fripp, Singapore (SG); Stephen Michael Greci, Little Elm, TX (US); Ryan W. McChesney, Prosper, TX (US); Ryan M. Novelen, Euless, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/035,650

(22) Filed: Jan. 23, 2025

(51) Int. Cl.
*E21B 34/06* (2006.01)

(52) U.S. Cl.
CPC ..... *E21B 34/063* (2013.01)

(58) Field of Classification Search
CPC ..... E21B 34/063
See application file for complete search history.

(56) References Cited

U.S. PATENT DOCUMENTS

| | | | | |
|---|---|---|---|---|
| 8,684,094 | B2 | 4/2014 | Greci | |
| 2009/0014168 | A1* | 1/2009 | Tips | E21B 34/102 166/73 |
| 2013/0020088 | A1 | 1/2013 | Dyer et al. | |
| 2013/0299198 | A1 | 11/2013 | Gano et al. | |
| 2016/0369592 | A1* | 12/2016 | Aitken | E21B 34/063 |
| 2019/0195047 | A1* | 6/2019 | Rong | E21B 43/08 |
| 2019/0345793 | A1* | 11/2019 | Rong | E21B 43/12 |
| 2020/0095851 | A1* | 3/2020 | Stojkovic | E21B 43/12 |
| 2020/0208496 | A1* | 7/2020 | Veselka | E21B 43/086 |

FOREIGN PATENT DOCUMENTS

| | | | |
|---|---|---|---|
| CN | 111963113 | A | 11/2020 |
| EP | 3017141 | A1 | 5/2016 |

OTHER PUBLICATIONS

International Patent Application No. PCT/US2025/017268, International Search Report and Written Opinion mailed Oct. 16, 2025, 10 pages.

Halliburton Energy Services, Inc., "EquiFlow Density™ Autonomous Inflow Control Completion System", Product Sheet, Sep. 2024, 1 page.

Inflow Control, "AICV—Autonomous Inflow Control Valve", Product Sheet, 2021, 2 pages.

* cited by examiner

*Primary Examiner* — David Carroll
(74) *Attorney, Agent, or Firm* — Kilpatrick Townsend & Stockton LLP

(57) ABSTRACT

A valve system can include a valve and a support. The valve can be positioned and can be actuated in a wellbore to control flow of fluid by being actuated to a closed position to prevent the flow of fluid in the wellbore. The support can be positioned to controllably override the valve to allow the flow of the fluid while the valve is being biased towards the closed position. The support can be degraded to allow the valve to prevent flow of fluid in the wellbore while being biased towards the closed position.

20 Claims, 6 Drawing Sheets

VALVE SYSTEM WITH TEMPORARY SUPPORT FOR CONTROLLING FLOW OF FLUID IN A WELLBORE

TECHNICAL FIELD

The present disclosure relates generally to wellbore operations and, more particularly (although not necessarily exclusively), to a valve system that includes one or more temporary supports that can bias the valve system in a free-flow position to control flow of fluid in a wellbore.

BACKGROUND

Wellbore operations may include various equipment, components, methods, or techniques to perform various tasks, such as fluid control, with respect to a wellbore. In some examples, the wellbore operations may involve controlling the flow of fluid, such as wellbore fluid or formation fluid, with respect to a wellbore. A valve can be used to control the flow of fluid, for example, by opening or closing to allow or prevent the fluid from flowing. Certain fluids may be preferable to be produced via the wellbore during one stage of the wellbore, while the certain fluids may not be preferable to be produced via a later stage of the wellbore. Controlling flow of the certain fluids at different stages of the wellbore can be difficult.

DETAILED DESCRIPTION

Figure 1:
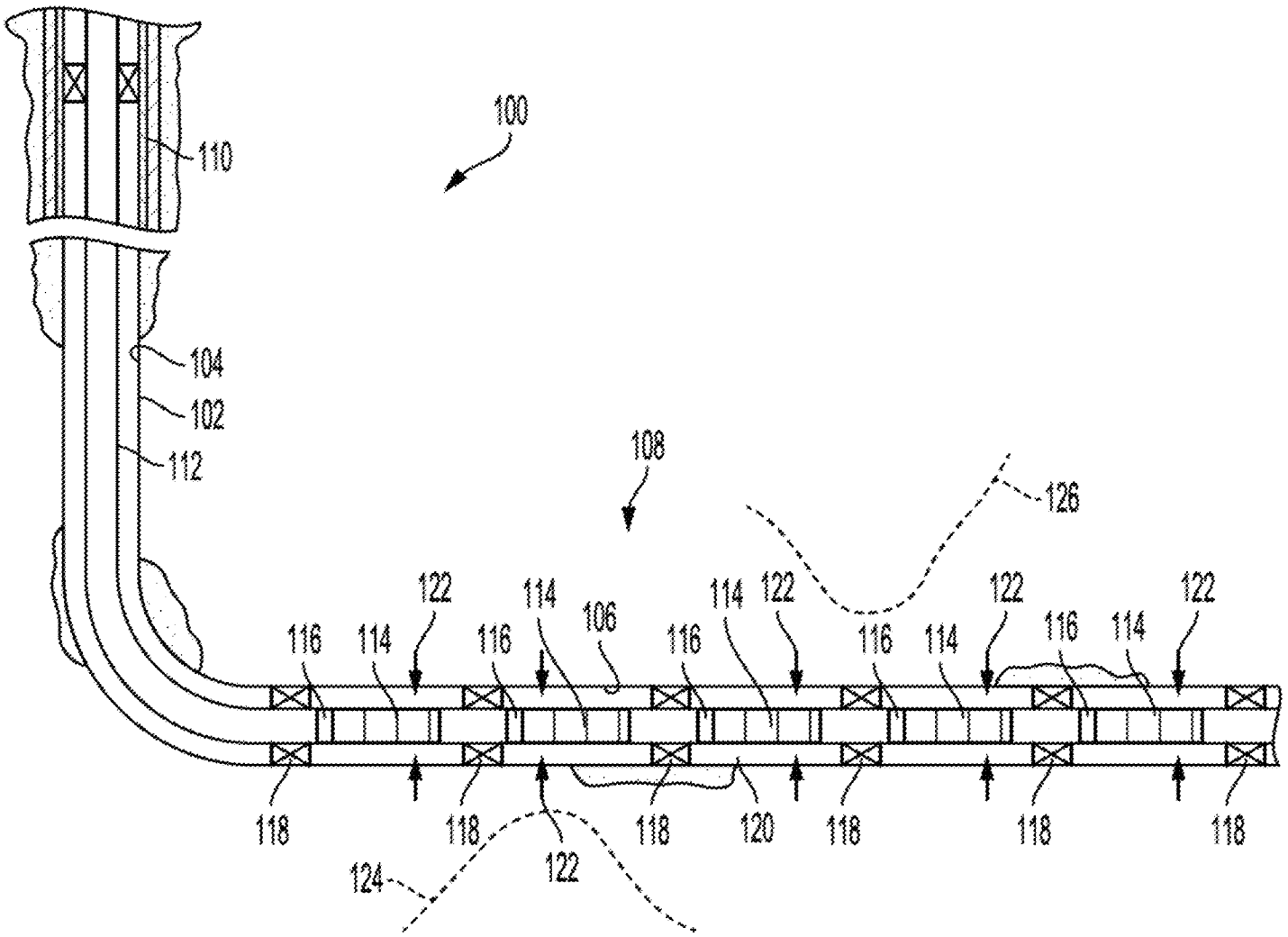
FIG. 1 is a diagram of a well system that can include a valve system with a temporary support according to some aspects of the present disclosure.

Certain aspects and examples of the present disclosure relate to a valve system that includes temporary supports for controlling flow of material with respect to a wellbore. The wellbore may be formed in a formation that can include various material such as water, oil, gas, other material, or any combination thereof. The valve system can be used to control flow of the material from the wellbore into the production tubing, to control flow of material from the production tubing into the wellbore, or to otherwise control flow of the material with respect to the wellbore. The valve system can use the temporary supports to control the flow. For example, the temporary supports may retain the valve system in an open or free-flow orientation even if the valve system receives a biasing force that would otherwise, such as without the temporary supports, close the valve. By retaining the valve system in the open or the free-flow orientation, unwanted materials, or materials desired to be removed prior to a production phase of the wellbore, can be removed. After a predetermined amount of time, or in response to a trigger, the temporary supports may degrade, or may be caused to be degraded, to allow the valve system to function normally.

Flow control systems can use a valve that uses pressure to actuate depending on the properties of the fluid that is flowing with respect to the valve. Actuation of the valve can be driven by a pilot line source that can deliver a change in fluid pressure when unwanted fluids are experienced. For wellbore cleanup and early stages of commercial wells, overriding closure actuation of the valve to unwanted fluids, such as with dense or viscous fluids including mud or completion brine, can improve a function of the wellbore compared to other systems with other valves. The flow control system valve can be retained in an open or free-flow orientation such that, for a temporary period of time, the actuation of the valve can be overridden to allow the flow of heavier or unwanted fluids out of the wellbore or formation. In some examples, overriding the actuation of the valve to cause the valve to be retained in the open orientation can involve retaining the valve completely open or at least partially open such that the valve is not closed and is not blocking fluid flow. For example, the valve may be completely open and may allow free-flow of fluids. In other examples, the valve may be partially open with a partial restriction of the flow of fluids. One or more temporary supports may be included in the flow control system, or the valve system thereof, to facilitate the actuation or piloting override. In some examples, the one or more temporary supports, or any subset thereof, may be positioned in a fluid flow path through the valve.

In some examples, the temporary supports may allow the flow control system, or the valve system thereof, to assist in well completion operations or in other suitable stages of a wellbore. By using the flow control system that includes the temporary supports, wellbore clean-up time, and by extension rig time, can be reduced with respect to other systems that do not use the temporary supports. In injection scenarios, the flow control system with the temporary supports can allow for lesser restriction and rig time, compared to the other systems that do not use the temporary supports, for a given period of time.

A valve system, which may be similar or identical to the flow control system described above, can include a valve and a support and can be positioned in a wellbore. The valve may be or include a pilot-actuated valve that can be actuated by receiving, or not receiving, pressure from a pilot line or from other suitable sources with respect to the wellbore. The support may be or include a temporary support that can override actuation of the valve. For example, the valve may receive pressure from the pilot line, and the pressure may bias the valve into a closed position that would, in the absence of the support, cause the valve to close and prevent flow of material across the valve. The support can override the pressure by retaining the valve in the open orientation. Overriding the pressure can involve physically preventing the valve from closing, can involve applying an opposing pressure or force on the valve to cancel the received pressure, etc.

In some examples, the support can be made of or otherwise include a degradable material. After a predetermined amount of time, or after receiving a trigger, the support may decay and lose the ability to retain the valve in the open orientation. In some examples, the decay or degradation of the support can be caused after wellbore cleanup of a dense mud or brine or other unwanted material. After the support degrades and is no longer able to retain the valve in the open orientation, the valve may return to original functionality for the remainder of the life of the completion or the wellbore. For example, after the support degrades and is no longer able to retain the valve in the open orientation, the valve may be closed by receiving the pilot pressure and may otherwise control, by encouraging or choking, flow of material with respect to the wellbore. In some examples, controlling flow of material with respect to the wellbore can include allowing material to flow from the wellbore into the production tubing, or vice versa, choking or preventing material from flowing into the production tubing from the wellbore, or vice versa, allowing material to flow in an annulus of the wellbore, choking or preventing material from flowing in the annulus, etc.

In some examples, the degradable material of the support may be or include a polymer that hydrolyzes over time, may be or include a material that uses an acid interaction to dissolve, may be or include a material that uses an alkali interaction to dissolve, may be or include a material that uses a galvanic reaction to breakdown, may be or include a material that can break down with prolonged exposure to elevated temperatures, may be or include or a metal that dissolves, or may be or include other suitable degradable materials. In some examples, the support can include an aluminum alloy. Additionally or alternatively, the support can include a magnesium alloy. The alloy can be doped with cathodic components, such as iron, nickel, copper, carbon, or indium, to accelerate a corrosion operation.

In some examples, the support can be coated with protective layer, such as via anodization or with paint, to delay the onset of corrosion. Additionally or alternatively, the support can be or include a polymer such as polylactic acid, polyglycolic acid, polycaprolactone, aliphatic polyesters, epoxy, and phenolic. In further examples, the polymer may include an aromatic copolyester such as an aromatic polyester thermoset. The polymer may be combined with fibers or particles, such as glass fibers or carbon particles, to enhance an operation or degradation of the support.

In some examples, the support can be or include a dissolvable metal. A dissolvable metal can degrade through dissolution, galvanic action, microgalvanic action, corrosion, disassociation, other suitable dissolving mechanisms, or any combination thereof. The dissolvable metal can include an aluminum-based alloy or a magnesium-based alloy. The aluminum-based alloy or magnesium-based alloy can include an anodic phase in the alloy. The dissolvable metal can be doped with elements, such as a dopant, to create sites for cathodic corrosion. The dopant can be added through a powder metallurgy process, through a solid solution process, through other suitable processes, or through a combination thereof. The dopant can be a nanocomposite or can form intergranular and intragranular cathodic phases.

In some examples, the dopant can be or include zinc, iron, nickel, tin, copper, silver, titanium, gold, graphite, or any combination thereof. In a dissolvable metal formed through powder metallurgy, the cathodic areas can be pressed or forged with the anodic metal. In a solid solution process, the cathode can be or include a cathodic phase within the metal and can form as intergranular regions or intragranular regions around the grains of the base metal. During dissolution, the cathodic phase can react with the base metal to produce metal ions and a small amount of hydrogen gas.

In some examples, the dissolvable metal can be alloyed with an element that can help break down the passivation on the surface of the dissolvable metal. For example, an aluminum alloy can be alloyed with a post-transition metal such as indium, gallium, or mercury. The post-transition element can act as a de-passivation agent and can prevent the formation of a protective passivation layer on the surface of the aluminum. Gallium, indium, and tin can, individually or in combination, act as de-passivation agents and can help to prevent passivation on the aluminum. Examples of aluminum-gallium alloys can include 80% aluminum-20% gallium, 80% aluminum-10% gallium-10% indium, 75% aluminum-5% gallium-5% zinc-5% bismuth-5% tin-5% magnesium, 90% aluminum-2.5% gallium-2.5% zinc-2.5% bismuth-2.5% tin, and 99.8% aluminum-0.1% indium-0.1% gallium, though other suitable alloys are also possible.

In some examples, a dissolvable metal can include a metal that has a dissolution rate in excess of 0.01 mg/cm$^2$/hour at 200° F. (93.33° C.) in 15% KCl. Additionally or alternatively, the dissolvable metal may lose greater than 0.1% of its total mass per day at 200° F. (93.33° C.) in 15% KCl. The dissolvable metal can degrade via galvanic action, microgalvanic action, corrosion, dissolution, disassociation, or any combination thereof.

In some examples, the support may be or include a dissolvable plastic or a hydrolyzable polymer. A dissolvable plastic can be or include a material that can hydrolytically degrade. A dissolvable plastic may include a mixture of a polymer and solid precursor in which the solid precursor can chemically react in the wellbore to promote the degradation of the dissolvable plastic. In some cases, the solid precursor is a hydrolyzable material that can change the pH of the fluid to be more acidic or to be more alkali. Examples of a dissolvable plastic can include polyglycolide (PGA), polylactic acid (PLA), thiol, acrylate, thermoplastic polyurethane (TPU), natural rubber, rubber-modified polystyrene, and acrylic rubber, though other examples are also possible. The dissolvable plastic may also include an aromatic polyester thermoset into which a solid precursor is a hydroxide releasing agent such as sodium hydroxide or sodium pentaborate. Additionally or alternatively, one or more of the foregoing can be combined together to form the support. In some examples, the dissolvable plastic can be or include a rubber that can include of aromatic TPU or an aliphatic TPU. Additionally or alternatively, the dissolvable plastic can be or include an aliphatic polyester in which the hydrolysable ester bond on the aliphatic polyester can cause the dissolvable plastic to degrade in water. Examples of the foregoing can include:

PLA. PLA can be obtained from polycondensation of D- or L-lactic acid or from ring opening polymerization of lactide. This can lead to semi-crystalline PLLA and amorphous PDLLA. A lower level of crystallinity can be achieved to promote degradation of the dissolvable plastic.

PGA and poly(lactic-co-glycolic acid) (PLGA).

Poly(caprolactone) (PCL).

Polyhydroxyalkanoate.

In some examples, the dissolvable plastic can dissolve at a rate of approximately 0.001 mm/hour to approximately 2 mm/hour in 120° F. (48.89° C.) tap water. Additionally or alternatively, the dissolvable plastic can dissolve at a rate of approximately 0.001 mm/hour to approximately 2 mm/hour in 180° F. (82.22° C.) tap water. Additionally or alternatively, the dissolvable plastic can dissolve at a rate of approximately 0.001 mm/hour to approximately 2 mm/hour in 250° F. (121.11° C.) tap water. As used herein, approximately indicates that a recited value may vary, such as above or below, by 1%, 2%, 3%, 4%, 5%, from 5% to 10%, from 10% to 20%, and the like.

In some examples, the support may be degraded through fluid erosion. The fluid passing by, and in contact with, the support can abrade the structure of the support through abrasion by the fluid flow. Through fluid-driven abrasion, the support can degrade to the point of failure of the support, and the valve operation can recommence after failure of the support.

In some examples, a support that can be degraded through erosion can have lower hardness and can have lower mechanical strength compared to other supports. Materials with controlled erosion resistance can include soft materials such as a rock (like talc or clay), a consolidated material that can include particulates that are bound together, such as sandstone or composite, or polymers such as polyether ether ketone (PEEK). An erosion operation may be used to remove a delay barrier on an exterior of the dissolvable support. The erosion operation may be used to accelerate the degradation of the dissolvable support and can include circulating fluids that contain solids past the support.

In some examples, the support can degrade, whether fully or at least partially to allow normal function of the valve, after one day, after one week, after one month, or after other suitable predetermined amounts of time. Additionally or alternatively, the support can be triggered to degrade after one day, after one week, after one month, or after other suitable predetermined amounts of time. Triggering the degradation of the support can include injecting acid, brine, alkali, or other wellbore fluid into the valve system to cause the support to degrade. Prior to being degraded, the support may provide structural support for the valve system. Ranges of time for the structural support can include from approximately two days to approximately two weeks, from approximately one week to approximately two months, from approximately one month to approximately six months, etc.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a diagram of a well system 100 that can include a valve system with a temporary support according to some aspects of the present disclosure. As illustrated in FIG. 1, the well system 100 may include a wellbore 102 that can include a generally vertical section 104, which may be uncased, and that may transition into a generally horizontal section 106 that may be at least partially uncased extending through a subterranean formation 108. In some examples, the vertical section 104 may extend downwardly from a portion of the wellbore 102 having a string of casing 110 cemented therein. A tubular string, such as production tubing 112, may be installed in or otherwise extended into the wellbore 102.

As illustrated in FIG. 1, a set of well screens 114, flow control devices 116, and packers 118 may be interconnected along the production tubing 112, such as along portions of the production tubing 112 in the horizontal section 106 of the wellbore 102. The packers 118 may be arranged to seal off an annulus 120 defined between the production tubing 112 and walls of the wellbore 102. As a result, fluids 122, which may include liquids, gases, other suitable phases, or any combination thereof, may be produced from multiple intervals of the subterranean formation 108 via isolated portions of the annulus 120 between adjacent pairs of the packers 118.

As illustrated in FIG. 1, a well screen 114 and a flow control device 116 may be interconnected in the production tubing 112 and may be positioned between a pair of the packers 118. In some examples, the well screens 114 may be or include swell screens, wire wrap screens, mesh screens, sintered screens, expandable screens, pre-packed screens, treating screens, other suitable types of screens, or any combination thereof. The well screen 114 may filter the fluids 122 flowing into the production tubing from the annulus 120. The flow control device 116 may allow, may restrict, or may otherwise regulate or control the flow of the fluids 122 into the production tubing 112, for example based on certain physical characteristics of the fluids 122.

In some examples, the flow control device 116 may be or include a centrifugal fluid selector that includes a portion thereof that may be actuated to rotate by the flow of the fluids 122. Additionally or alternatively, the flow control device 116 may be or include an autonomous flow control device that may use fluid dynamics and may delay the flow of unwanted fluid into the interior of the production tubing 112. Unwanted fluids may be or include water, gas, mud, or other fluids or materials that may not be desired to be produced during a production phase of the wellbore 102.

In some examples, the flow control device 116 may operate as a passive flow control device that may not require operator intervention to operate. An operator may be or include an individual, a group of individuals, an organization, etc. The flow control device 116 may have any suitable shape. For example, the flow control device 116 may have cross-sectional shapes that are circular, elliptical, triangular, rectangular, square, hexagonal, octagonal, of irregular shape, or any combination thereof. Additionally or alternatively, the flow control device 116 can be made of, or may include, any suitable materials such as metals, nonmetals, polymers, ceramics, or any combination thereof. In some examples, the flow control device 116 may be made of or may include tungsten carbide, steel, or a combination thereof.

In some examples, the flow control device 116 may be or include a valve system that can include a valve and a support. The support may be or include a temporary support that may naturally degrade, or that may be triggered to be decayed, over a predetermined amount of time. The support may override pilot pressure, or other actuation forces, received by the flow control device 116 to cause the flow control device 116 to be retained in an open or free-flow position to allow, for example, a wellbore cleaning operation to be performed. In some examples, the valve may be located in a flow path between the well screen 114 and the production tubing 112. Additionally or alternatively, the valve may be positioned for controlling the fluid flow from the subterranean formation 108 into the production tubing 112.

It will be appreciated that the well system 100 is merely one example of a wide variety of well systems in which the principles described herein may be used. Accordingly, it should be understood that the principles described herein are not necessarily limited to any of the details of the well system 100, or the various components, thereof, depicted in the drawings or otherwise described herein. For example, the wellbore 102 may not include the generally vertical section 104 or the generally horizontal section 106. Moreover, the fluids 122 may, instead of or in addition to being produced from the subterranean formation 108, be injected into the subterranean formation 108.

In some examples, the arrangement of the well screen 114, the flow control device 116, and a pair of the packers 118 may differ from the example depicted in FIG. 1. Additionally or alternatively, the flow control device 116 and the well screen 114 may not be in one-to-one correspondence, as is depicted in FIG. 1. For example, more than one flow control device 116 may be used per well screen 114 or more than one well screen 114 may be used per flow control device 116. Any suitable number, arrangement, or combination of the well screen 114, the flow control device 116, and the packers 118 may be used consistent with the principles described herein. In some examples, such as injection examples, injected fluid in the wellbore 102 may flow through the flow control device 116 without also flowing through the well screen 114.

Regulating fluid flow with respect to the wellbore 102 and using the flow control device 116 may provide improvements to the well system 100 compared with other well systems that do not use the flow control device 116. For example, the flow control device 116 can prevent water coning 124 or gas coning 126 in the subterranean formation 108. Additionally or alternatively, the flow control device 116 can include balancing production from, or injection into, multiple zones, minimizing production or injection of undesired fluids, maximizing production or injection of desired fluids, etc. In some examples, a temporary support included in the flow control device 116 can allow the flow control device 116 to facilitate a wellbore cleaning operation to remove unwanted materials from the wellbore 102, from the subterranean formation 108, or a combination thereof such as in a completion phase of the wellbore 102.

Figure 2:
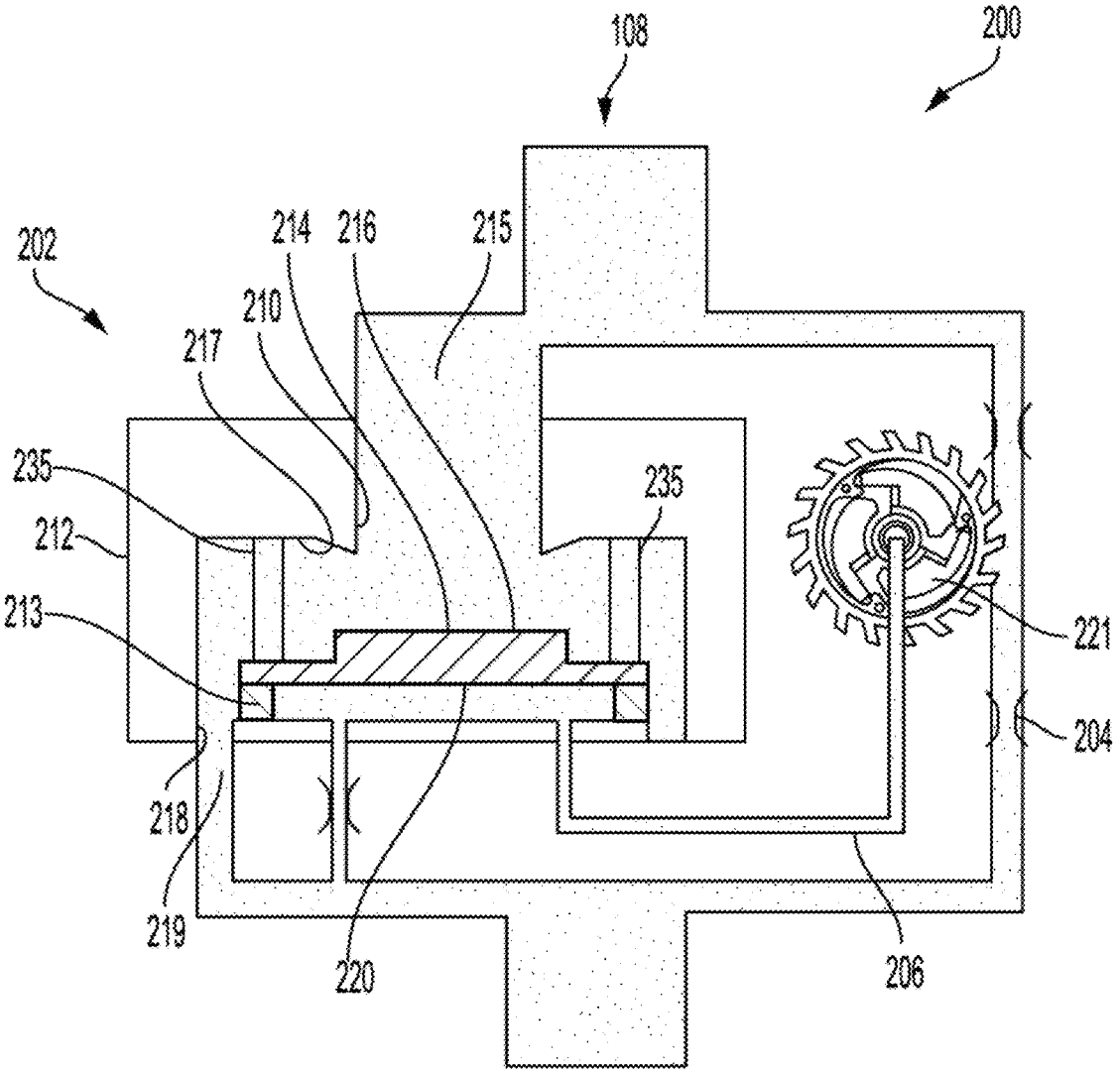
FIG. 2 is a diagram of a valve system that can include a temporary support according to some aspects of the present disclosure.

FIG. 2 is a diagram of a valve system 200 that can include a temporary support according to some aspects of the present disclosure. In some examples, FIG. 2 illustrates the valve system 200 that can control flow of the fluids 122 with respect to the wellbore 102. The valve system 200 can control, such as encourage or restrict, flow of the fluids 122 from the subterranean formation 108 to the wellbore 102 or the production tubing 112, or the annulus 120 thereof, or vice versa. As illustrated in FIG. 2, the valve system 200 is in an open or free-flow orientation, but it is possible for the valve system 200 to be actuated, such as via a pilot pressure or other force, into a closed orientation.

In some examples, the valve system 200 can include a valve 202 that can include a piston 214 that can be coupled to a valve housing 212 by a bellows 213. A diaphragm may be used in place of the bellows 213, and the bellows 213 may be any suitable size, height, shape, or a combination thereof. The bellows 213 may include walls that expand or compress when acted upon. The bellows 213 may couple the piston 214 onto an internal wall of the valve housing 212 through the use of any suitable mechanisms such as one or more fasteners, threading, one or more adhesives, welding, or any combination thereof. The fasteners can include nuts and bolts, washers, screws, pins, sockets, rods and studs, hinges, or any combination thereof.

In some examples, the valve 202 may include an inlet restriction 215, a piston seat 217, and an outlet restriction 219. The inlet restriction 215 may be or include a nozzle, a vortex, a change in tubing or pipe diameter, a fluid diode, or other centrifugal flid selector disposed near valve inlet 210. The piston seat 217 may be sized, shaped, arranged, or a combination thereof, to receive the piston 214 as the piston 214 is actuated to displace linearly. The piston seat 217 may have any suitable size, height, shape, etc. compatible for receiving the piston 214. In some examples, a pressure drop may occur as the flow of the fluids 122 passes the piston seat 217. As the fluids 122 travel through the valve 202, the fluids 122 may encounter the outlet restriction 219. In some examples, the outlet restriction 219 can be a nozzle, a vortex, a change in tubing or pipe diameter, a fluid diode, other centrifugal fluid selector, or any combination thereof disposed near a valve outlet 218.

In some examples, such as examples in which the fluids 122 include mostly oil, little fluid may flow through an inflow device 221 and subsequently through a control line 206. In such examples, the fluids 122 may flow past the inflow device 221 and encounter a pressure reduction from a fluid restrictor 204. Since the pressure within the above-described flow path has been reduced, the fluids 122 may flow through the valve 202. In some examples, the fluids 122 may include or convey pressure from the subterranean formation 108, and there may be little to no pressure applied to the piston 214 from the control line 206. As such, the piston 214 may be actuated to displace to allow the fluids 122 to flow out of the valve outlet 218 and into an interior of the production tubing 112. Displacing the piston 214 to create a greater flow path for the fluids 122 may involve compressing the bellows 213.

In some examples, such as examples in which the fluids 122 include mostly water, the fluids 122 may enter and exit the inflow device 221 and flow through the control line 206. The control line 206 may be coupled to the valve 202. The control line 206 may exit into an interior of the bellows 213. The control line 206 can provide the fluids 122 in an interior of the bellows 213. The pressure within may build and may be applied to a second end 220 of the piston 214. In some examples, the pressure applied to the second end 220 may be greater than a pressure supplied by the subterranean formation 108 may encounter the inlet restriction 215 and the piston seat 217 prior to being applied to a first end 216 of the piston 214. The piston 214 may be actuated to displace such that the first end 216 inhibits the flow of the fluids 122 from entering into the valve inlet by abutting against the piston seat 217.

In some examples, the valve 202 can include a support 235. The support 235 may physically hold open or retain the valve 202 in the open orientation to allow free-flow of fluid through the valve 202. The support 235 may be degradable. That is, after a certain amount of predetermined time, or after receiving a trigger, the support 235 may structurally degrade, such as dissolve, disintegrate, or otherwise structurally fail, to allow the valve 202 to return to normal function. Normal function, in some examples, can involve the valve 202 closing in response to receiving a biasing force for closing the valve 202.

Figure 3:
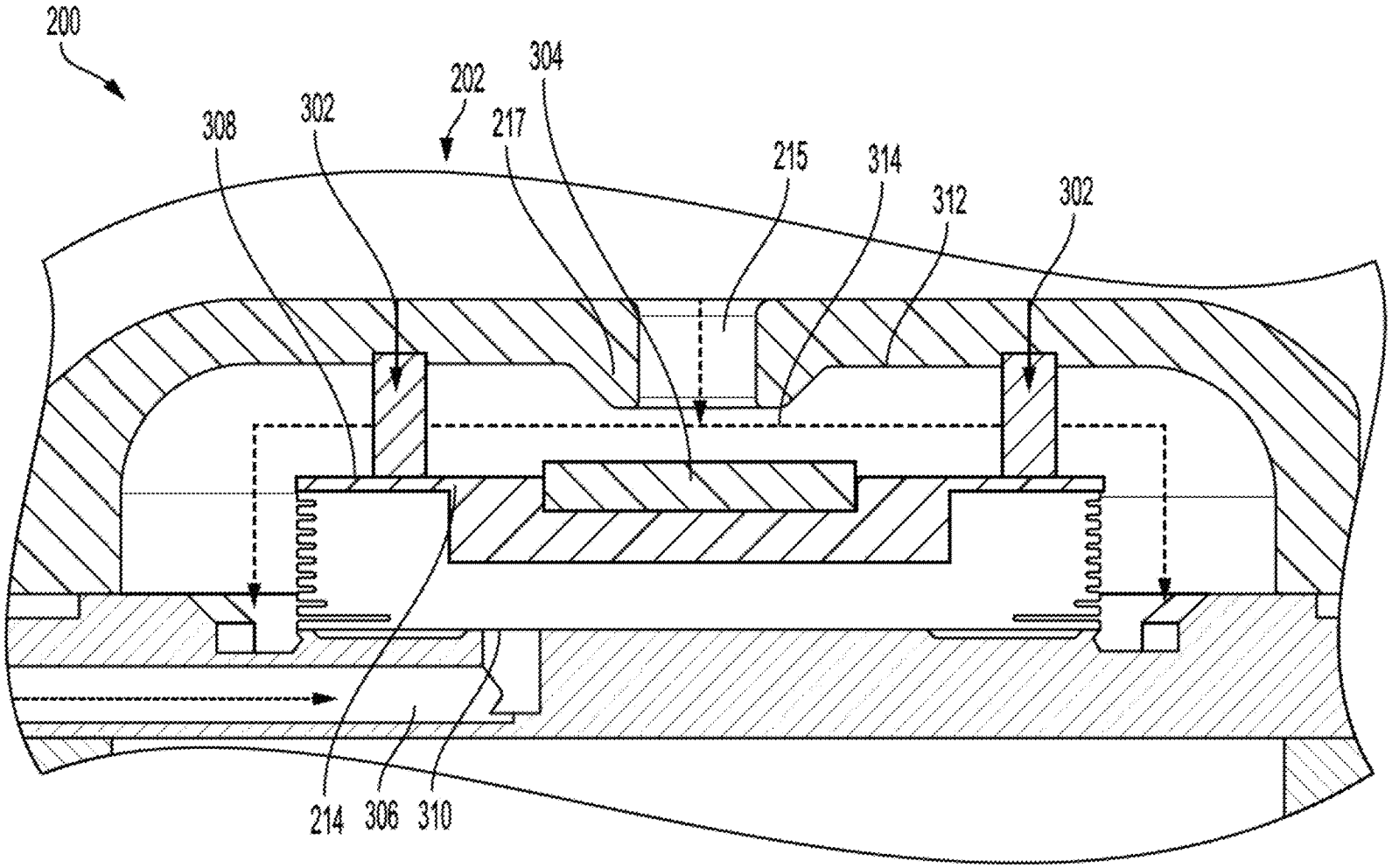
FIG. 3 is a sectional view of a valve system with a compression-based temporary support according to some aspects of the present disclosure.

FIG. 3 is a sectional view of a valve system 200 that includes a compression-based temporary support 302 according to some aspects of the present disclosure. As illustrated in FIG. 3, the valve system 200 can include the compression-based temporary support 302 and a valve 202. In other examples, the valve system 200 may include any additional, alternative, or fewer components compared with the valve system 200 illustrated in FIG. 3. In some examples, the valve 202 can include a piston 214, a valve seat 304, an inlet restriction 215, and a piston seat 217, though additional or alternative components are possible for the valve 202. In some examples, the piston 214 can be or include a moveable member that can translate in a linear direction. Additionally or alternatively, the piston 214 can be or include a bellows, a plate, other suitable moveable member, or any combination thereof. The piston 214 can be sealed, such as with a bellows or an O-ring, or the piston 214 can be unsealed.

The valve 202 may be arranged in the valve system 200 to be in a closed orientation, in an open orientation, or somewhere in-between such as a partially open orientation. In the open orientation, as illustrated in FIG. 3, the valve 202, or any component thereof, such as the piston 214 or the valve seat 304, may not be seated against the piston seat 217, and fluid, such as from the subterranean formation 108 or from the wellbore 102, may freely flow through the valve 202. In the closed orientation, the valve 202, or any component thereof, such as the piston 214 or the valve seat 304, may be seated against the piston seat 217, and fluid, such as from the subterranean formation 108 or from the wellbore 102, may not flow through the valve 202. The valve 202, or the valve system 200, may be adjusted from the open orientation to the closed orientation, or vice versa, by controlling a biasing pressure applied to the valve 202. In some examples, such as the example illustrated by FIG. 3, the biasing pressure can originate from a pilot line 306 that can be positioned in the valve system 200 or in the wellbore 102 such as in a casing positioned in the wellbore 102. In other examples, the biasing pressure can originate from other suitable sources that are not the pilot line 306 as illustrated in FIG. 3. For example, the pilot pressure can originate from nozzles, long tubes, centrifugal devices, rotating vortices, porous membranes, other suitable pilot sources, or any combination thereof.

The biasing pressure may be applied to the valve 202 to cause the valve 202 to close and prevent fluid flow through or across the valve system 200. The compression-based temporary support 302 may be used to override the biasing pressure. For example, the compression-based temporary support 302 can physically prevent the valve 202 from actuating in response to the valve 202 receiving the biasing pressure. The compression-based temporary support 302 can have a sufficient amount of structural support to retain the valve 202 open by applying an equal and opposite force, compared with the biasing pressure, to the valve 202. For example, the valve 202 can include a first side 308, such as a top side, and a second side 310 such as a bottom side. The biasing pressure can be applied to the second side 310, and the compression-based temporary support 302 can apply an equal and opposite force, compared with the biasing pressure, to the first side 308 via compression to retain the valve 202 in the open orientation. In some examples, force can be applied on the top side through a lift force as fluid flows across the valve 202 or any component thereof such as the piston 214.

In some examples, the compression-based temporary support 302 can have any suitable shape or size to override the biasing pressure and to retain the valve 202 in the open or free-flow orientation. Examples of the shape of the compression-based temporary support 302 can include a cylindrical shell, one or more pillars, a ring with rods disposed on or near the circumference thereof, or other suitable shapes. The size of the compression-based temporary support 302 can be such that the compression-based temporary support 302 can fit between the piston 214 and the piston seat 217 or a wall 312 of the valve system 200. The compression-based temporary support 302 can have or define a central channel 314 through which fluid can flow while the compression-based temporary support 302 retains the valve 202 in the open orientation.

In some examples, the compression-based temporary support 302 can be made of or include any suitable material that can degrade or that can be triggered to degrade after a predetermined amount of time. The compression-based temporary support 302 can be made of or include a dissolvable metal, a dissolvable plastic, other suitable degradable material as discussed above, or any combination thereof. For example, the compression-based temporary support 302 can be made of or include an aluminum alloy that includes a coating to encourage degradation over a predetermined amount of time. The compression-based temporary support 302 can degrade naturally or passively by being exposed to wellbore fluid, formation fluid, or a combination thereof. Additionally or alternatively, the compression-based temporary support 302 can be triggered to degrade over the predetermined amount of time by injecting certain wellbore fluids into the valve system 200. In some examples, the certain wellbore fluids may include an acid, water, other suitable wellbore fluids, or any combination thereof. After degrading past a threshold level, the compression-based temporary support 302 may structurally fail or disintegrate and allow the valve system 200, or each component thereof, to return to normal functionality.

Figure 4:
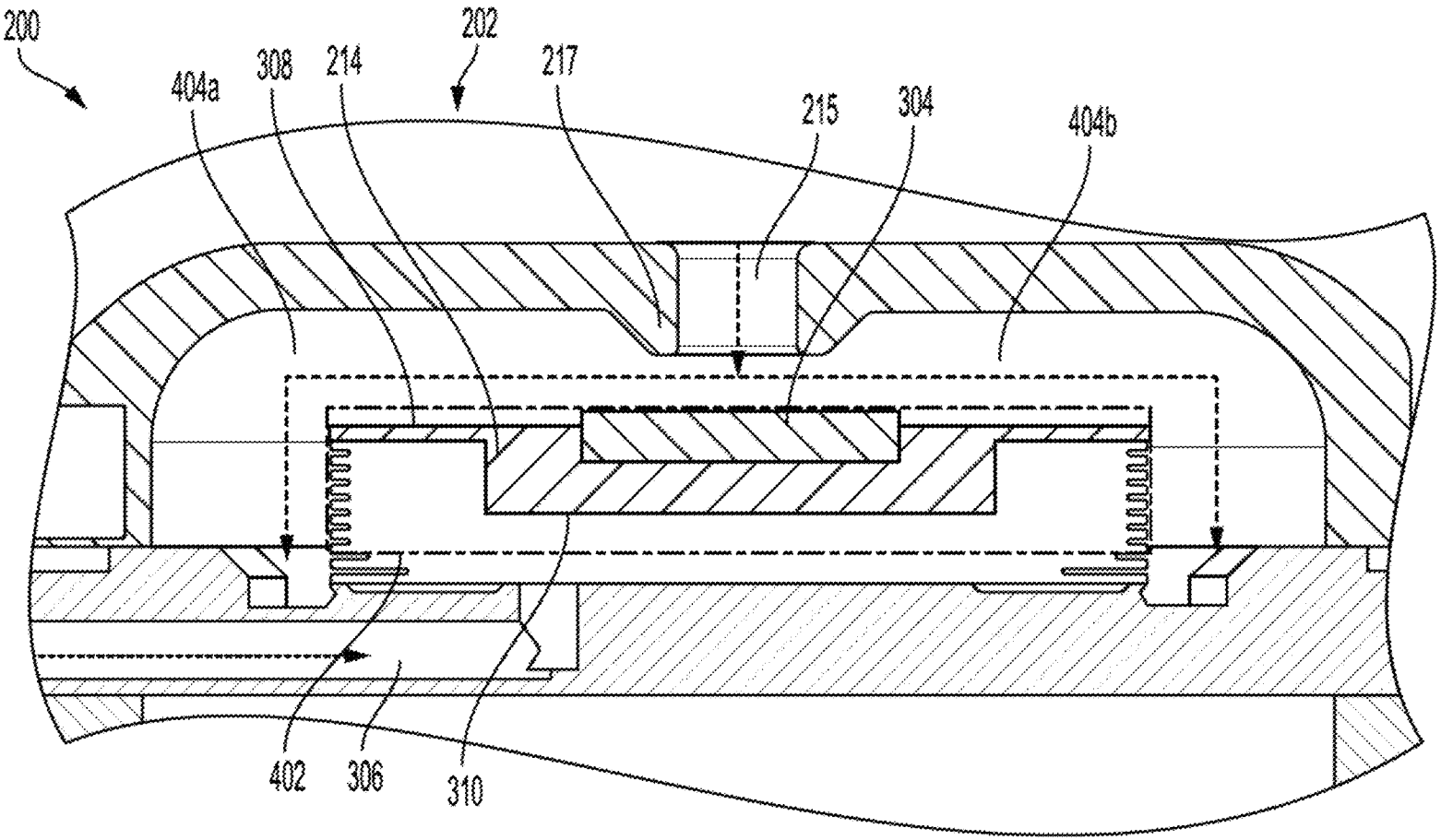
FIG. 4 is a sectional view of a valve system with a tension-based temporary support according to some aspects of the present disclosure.

FIG. 4 is a sectional view of a valve system 200 that includes a tension-based temporary support 402 according to some aspects of the present disclosure. As illustrated in FIG. 4, the valve system 200 can include the tension-based temporary support 402 and a valve 202. In other examples, the valve system 200 may include any additional, alternative, or fewer components compared with the valve system 200 illustrated in FIG. 4. In some examples, the valve 202 can include a piston 214, a valve seat 304, an inlet restriction 215, and a piston seat 217, though additional or alternative components are possible for the valve 202.

The valve 202 may be arranged in the valve system 200 to be in a closed orientation, in an open orientation, or somewhere in-between such as a partially open orientation. In the open orientation, as illustrated in FIG. 4, the valve 202, or any component thereof, such as the piston 214 or the valve seat 304, may not be seated against the piston seat 217, and the tension-based temporary support 402 may hold, via tension force, the valve 202 in the open orientation. As such, fluid, such as from the subterranean formation 108 or from the wellbore 102, may freely flow through the valve 202. In the closed orientation, such as after the tension-based temporary support 402 degrades, the valve 202, or any component thereof, such as the piston 214 or the valve seat 304, may be seated against the piston seat 217, and fluid, such as from the subterranean formation 108 or from the wellbore 102, may not flow through the valve 202. The valve 202, or the valve system 200, may be adjusted from the open orientation to the closed orientation, or vice versa, by controlling a biasing pressure applied to the valve 202. In some examples, such as the example illustrated by FIG. 4, the biasing pressure can originate from a pilot line 306 that can be positioned in the valve system 200 or in the wellbore 102 such as in a casing positioned in the wellbore 102. In other examples, the biasing pressure can originate from other suitable sources that are not the pilot line 306 as illustrated in FIG. 4.

The biasing pressure may be applied to the valve 202 to cause the valve 202 to close and prevent fluid flow through or across the valve system 200. The tension-based temporary support 402 may be used to override the biasing pressure. For example, the tension-based temporary support 402 can physically prevent, such as by holding open, the valve 202 from actuating in response to the valve 202 receiving the biasing pressure. The tension-based temporary support 402 can have a sufficient amount of structural or elastic support to retain the valve 202 open by applying a tension-based equal and opposite force, compared with the biasing pressure, to the valve 202. For example, the valve 202 can include a first side 308, such as a top side, and a second side 310 such as a bottom side. The biasing pressure can be applied to the second side 310, and the tension-based temporary support 402 can apply a tension-based equal and opposite force, compared with the biasing pressure, to the first side 308 via tension to retain the valve 202 in the open orientation.

In some examples, the tension-based temporary support 402 can have any suitable shape or size to override the biasing pressure and to retain the valve 202 in the open or free-flow orientation. Examples of the shape of the compression-based temporary support 302 can include a rectangular prism, a shape following a shape of the piston 214, or other suitable shapes. For example, the tension-based temporary support 402 may be or include a coating around the piston 214 or other components of the valve 202, or around the valve 202 itself, and the tension-based temporary support 402 may conform to a shape of the surfaces that the tension-based temporary support 402 coats. The size of the tension-based temporary support 402 can be such that the tension-based temporary support 402 can fit between the piston 214 and the piston seat 217 or a wall 312 of the valve system 200 or can fit around the valve 202 or any component or combination of components thereof. The tension-based temporary support 402 can define one or more annular channels, such as annular channel 404*a* and annular channel 404*b*, through which fluid can flow while the tension-based temporary support 402 retains the valve 202 in the open orientation.

In some examples, the tension-based temporary support 402 can be made of or include any suitable material that can degrade or that can be triggered to degrade after a predetermined amount of time. The tension-based temporary support 402 can be made of or include a dissolvable metal, a dissolvable plastic, a dissolvable adhesive, other suitable degradable material as discussed above, or any combination thereof. For example, the tension-based temporary support 402 can be made of or include an epoxy-based material that includes a coating to encourage degradation over a predetermined amount of time. The tension-based temporary support 402 can degrade naturally or passively by being exposed to wellbore fluid, formation fluid, or a combination thereof. Additionally or alternatively, the tension-based temporary support 402 can be triggered to degrade over the predetermined amount of time by injecting certain wellbore fluids into the valve system 200. In some examples, the certain wellbore fluids may include an acid, water, other suitable wellbore fluids, or any combination thereof. After degrading past a threshold level, the tension-based temporary support 402 may structurally fail or disintegrate and allow the valve system 200, or each component thereof, to return to normal functionality.

Figure 5:
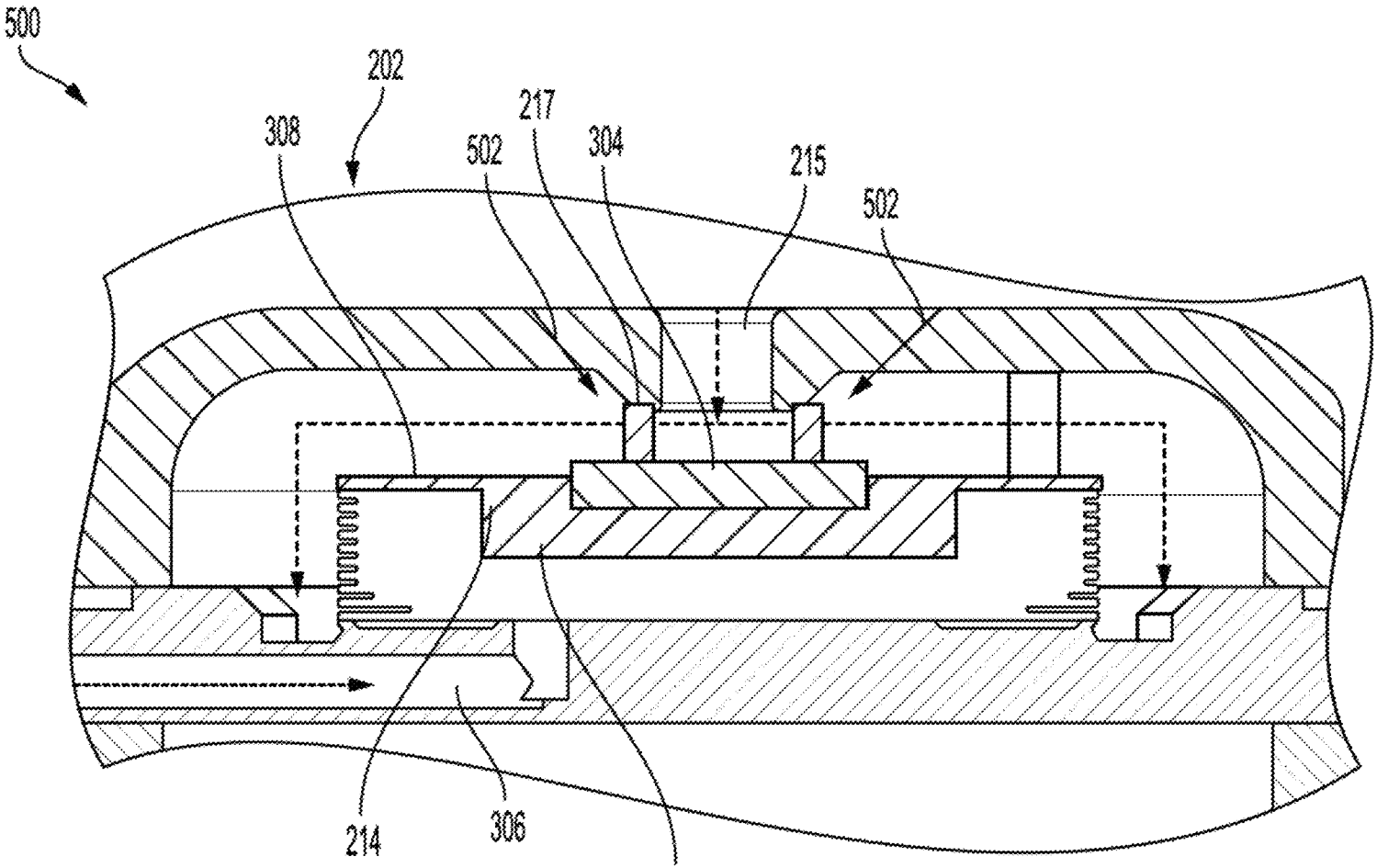
FIG. 5 is a sectional view of a valve system with another compression-based temporary support according to some aspects of the present disclosure.

FIG. 5 is a sectional view of a valve system 200 with a second compression-based temporary support 502 according to some aspects of the present disclosure. As illustrated in FIG. 5, the valve system 200 can include the second compression-based temporary support 502 and a valve 202. In other examples, the valve system 200 may include any additional, alternative, or fewer components compared with the valve system 200 illustrated in FIG. 5. In some examples, the valve 202 can include a piston 214, a valve seat 304, an inlet restriction 215, and a piston seat 217, though additional or alternative components are possible for the valve 202. The components of the valve system 200, with the exception of the second compression-based temporary support 502, may be similar or identical in structure, function, and the like to the components of the valve system 200 illustrated and described with respect to FIG. 3.

In some examples, the second compression-based temporary support 502 can have any suitable shape or size to override the biasing pressure and to retain the valve 202 in the open or free-flow orientation. Examples of the shape of the second compression-based temporary support 502 can include an open cylindrical shell that has a C-shaped cross-section, one or more pillars, an open ring with rods disposed on or near the circumference thereof, or other suitable shapes. The size of the second compression-based temporary support 502 can be such that the second compression-based temporary support 502 can fit between the piston 214 and the piston seat 217 or a wall 312 of the valve system 200. The second compression-based temporary support 502 can have or define a central channel 314 through which fluid can flow while the second compression-based temporary support 502 retains the valve 202 in the open orientation.

In some examples, the second compression-based temporary support 502 can be made of or include any suitable material that can degrade or that can be triggered to degrade after a predetermined amount of time. The second compression-based temporary support 502 can be made of or include a dissolvable metal, a dissolvable plastic, other suitable degradable material as discussed above, or any combination thereof. For example, the second compression-based temporary support 502 can be made of or include an aluminum alloy that includes a coating to encourage degradation over a predetermined amount of time. The second compression-based temporary support 502 can degrade naturally or passively by being exposed to wellbore fluid, formation fluid, or a combination thereof. Additionally or alternatively, the second compression-based temporary support 502 can be triggered to degrade over the predetermined amount of time by injecting certain wellbore fluids into the valve system 200. In some examples, the certain wellbore fluids may include an acid, water, other suitable wellbore fluids, or any combination thereof. After degrading past a threshold level, the second compression-based temporary support 502 may structurally fail or disintegrate and allow the valve system 200, or each component thereof, to return to normal functionality. In some examples, the second compression-based temporary support 502 may be positioned in the inlet restriction 215 and may have at least a central channel, an opening along a circumference, or other suitable opening to allow flow of fluid through the valve system 200.

In some examples, the second compression-based temporary support 502, the tension-based temporary support 402, the compression-based temporary support 302, or any combination thereof may be erodible. That is, the second compression-based temporary support 502, the tension-based temporary support 402, the compression-based temporary support 302, or any combination thereof may degrade via abrasion by exposure to wellbore fluid. Additionally or alternatively, the second compression-based temporary support 502, the tension-based temporary support 402, the compression-based temporary support 302, or any combination thereof may be or include circular columns that may be hollow and that may have a porosity exceeding approximately 20% such as a foam or a consolidated material. Additionally or alternatively, The materials, the thickness, or a combination thereof of the second compression-based temporary support 502, the tension-based temporary support 402, the compression-based temporary support 302, or any combination thereof can be customized to adjust a rate of degradation of the second compression-based temporary support 502, the tension-based temporary support 402, the compression-based temporary support 302, or any combination thereof.

Figure 6:
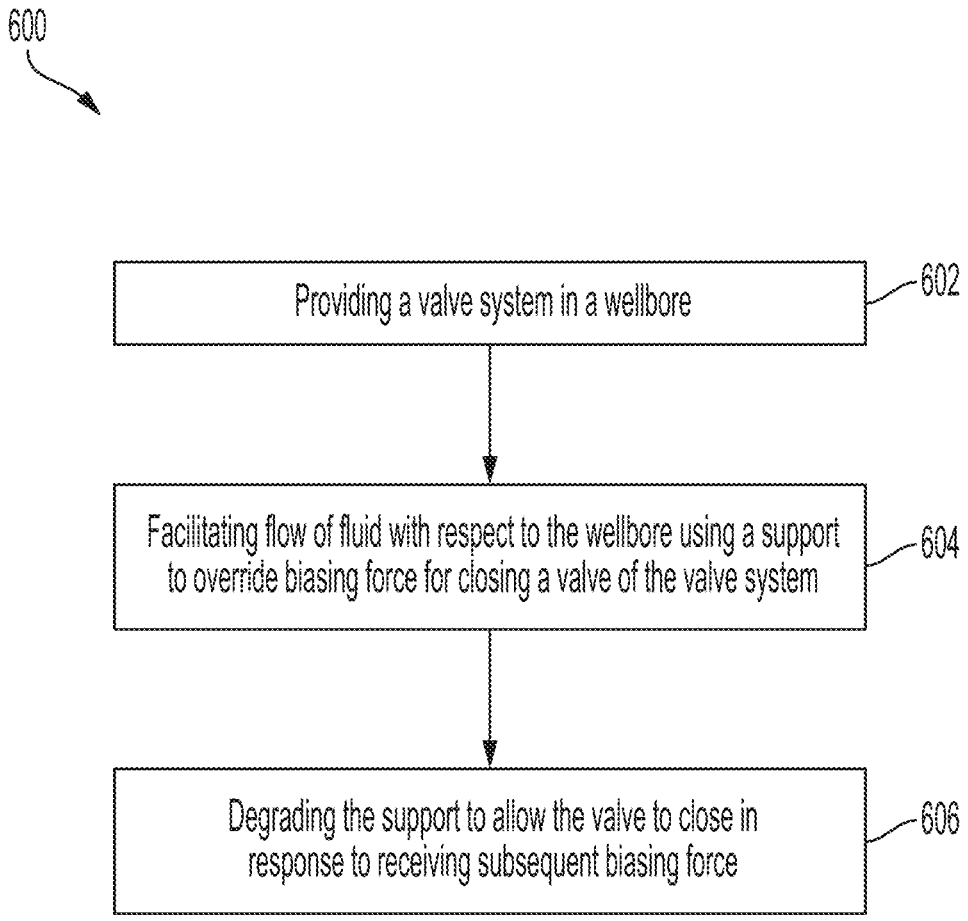
FIG. 6 is a flowchart of a process for using a valve system that can include a temporary support in a wellbore according to some aspects of the present disclosure.

FIG. 6 is a flowchart of a process 600 for using a valve system 200 that can include a temporary support in a wellbore 102 according to some aspects of the present disclosure. At block 602, a valve system 200 is provided in a wellbore 102. Providing the valve system 200 may include installing the valve system 200 in the wellbore 102, installing the valve system 200 in a casing intended to be, or already, positioned in the wellbore 102, providing access to the valve system 200, and the like. The valve system 200 can include a valve 202 and a support as illustrated and described in one or more of FIGS. 2-5. For example, the support can be or include the second compression-based temporary support 502, the tension-based temporary support 402, the compression-based temporary support 302, or any combination thereof.

At block 604, flow of fluid is facilitated using the valve system 200. The flow of fluid can be facilitated with respect to the wellbore 102. For example, fluid from a subterranean formation 108 can flow through the valve system 200 and into an interior or annulus of the wellbore 102 or into an interior of a casing or tubing installed in the wellbore 102. Additionally or alternatively, fluid from the wellbore 102 or the casing or tubing installed in the wellbore 102 can flow across the valve system 200 into the subterranean formation 108. In some examples, the flow of fluid may include unwanted fluids flowing out of the subterranean formation 108 or the wellbore 102 during a wellbore cleaning operation during a completion phase of the wellbore 102. That is, the valve system 200 can be used to perform a wellbore cleaning operation to remove unwanted material from the wellbore 102 prior to proceeding to a production operation with the wellbore 102.

The support of the valve system 200 can be used to facilitate flow of the unwanted material with respect to the wellbore 102. For example, the support can controllably override the valve 202 of the valve system 200 to allow flow of the unwanted material while the valve 202 is being biased towards the closed position. The valve 202 may receive a pilot pressure, or other suitable biasing force, that would, in the absence of the support, cause the valve 202 to close and prevent flow of the unwanted material. The support may physically retain the valve 202 open by overriding the pilot pressure or other biasing force. Overriding the pilot pressure or other biasing force can include applying an equal and opposite force, compared with the pilot pressure or other biasing force, to an opposite side of the valve 202 to cancel out the pilot pressure or other biasing force. The equal and opposite force applied by the support can involve a compression-based force, such as illustrated and described with respect to FIG. 3 and FIG. 5, a tension-based force, such as illustrated and described with respect to FIG. 4, or a combination thereof.

At block 606, the support is degraded to allow the valve system 200 to return to normal functionality. In some examples, normal functionality may include allowing the valve 202 to open and close based on pilot pressure or biasing force received by the valve 202. Degrading the support can include dissolving the support, disintegrating the support, eroding the support, otherwise causing the support to structurally fail or to be removed from the valve system 200, or any combination thereof. For example, such as examples in which the support includes an aluminum alloy, the support can be dissolved by injecting an acid into the valve system 200 to dissolve the aluminum alloy. In other examples, wellbore fluids can passively dissolve or disintegrate the support over a predetermined amount of time. Additionally or alternatively, the support can be eroded by injecting water or other eroding material into the valve system 200, by producing water or other eroding material via the valve system 200, or a combination thereof. Once degraded to a point exceeding a threshold level, the support may be carried out of the valve system 200 or may otherwise not be able to physically retain the valve 202 in an open or free-flowing orientation to override the pilot pressure or biasing force on the valve 202 to close the valve 202. After the support is degraded, the valve 202 may be allowed to be shut in response to receiving subsequent pilot pressure or biasing force for closing the valve 202.

In some aspects, valve systems and methods for a valve system with a temporary support for controlling flow of fluid with respect to a wellbore are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a valve system comprising: a valve positionable and actuatable in a wellbore to control flow of fluid by being actuatable to a closed position to prevent the flow of fluid in the wellbore; and a support in the valve to controllably override an actuation of the valve to allow the flow of the fluid while the valve is receiving a biasing force for closing the valve, the support being degradable to allow the valve to prevent flow of fluid in the wellbore after being biased into the closed position.

Example 2 is the valve system of example 1, wherein the support comprises a first material that is degradable after a predetermined amount of time in a presence of wellbore fluid, and wherein the first material comprises a dissolvable metal or a hydrolyzable polymer.

Example 3 is the valve system of example 1, wherein the valve has a top side and a bottom side, and wherein a first force is appliable from the support to the top side of the valve to oppose a second force appliable to the bottom side of the valve and to retain the valve open for a predetermined amount of time.

Example 4 is the valve system of example 3, wherein the second force is transmittable through a pilot line coupled with the valve system for applying the second force to the bottom side of the valve, wherein the second force is a pressure applicable as the biasing force.

Example 5 is the valve system of example 1, wherein the support comprises a compression-based temporary support that is positionable between the valve and an interior wall of the valve system to retain the valve in an open orientation while the valve is being biased towards the closed position.

Example 6 is the valve system of example 1, wherein the support comprises a tension-based temporary support that is positionable around a valve seat of the valve to provide a tension-based force to override the valve to allow the flow of the fluid while the valve is being biased towards the closed position.

Example 7 is the valve system of example 1, wherein the valve comprises: a piston actuatable between an open position and the closed position, and a housing comprising a piston seat opposing the piston and defining an inlet channel for directing the fluid into or out of the valve system; and wherein the support is positionable in the inlet channel to controllably override the valve to allow the flow of the fluid while the valve is being biased towards the closed position.

Example 8 is a method comprising: providing a valve system in a wellbore, the valve system comprising a valve and a support coupled with the valve; facilitating flow of fluid with respect to the wellbore using the valve system, the support overriding one or more biasing forces for closing the valve to allow the flow of fluid; and degrading the support to allow the valve system to close in response to receiving one or more subsequent biasing forces.

Example 9 is the method of example 8, wherein the support comprises a first material that comprises a dissolvable metal or a hydrolyzable polymer, and wherein degrading the support comprises degrading the first material after a predetermined amount of time in a presence of wellbore fluid, and wherein the first material.

Example 10 is the method of example 8, wherein the valve has a top side and a bottom side, and wherein facilitating the flow of the fluid comprises applying first force from the support to the top side of the valve to oppose a second force applied to the bottom side of the valve and to retain the valve open for a predetermined amount of time.

Example 11 is the method of example 10, wherein facilitating the flow of the fluid comprises transmitting the second force through a pilot line coupled with the valve system for applying the second force to the bottom side of the valve.

Example 12 is the method of example 8, wherein the support comprises a compression-based temporary support that is positioned between the valve and an interior wall of the valve system, and wherein facilitating the flow of fluid comprises using the compression-based temporary support to retain the valve in an open orientation while the valve is being biased towards a closed position.

Example 13 is the method of example 8, wherein the support comprises a tension-based temporary support that is positioned around a valve seat of the valve, and wherein facilitating the flow of the fluid comprises using the tension-based temporary support to provide a tension-based force to override the valve to allow the flow of the fluid while the valve is being biased towards a closed position.

Example 14 is the method of example 8, wherein degrading the support comprises triggering a degradation process of the support by injecting wellbore fluid into the valve system to degrade the support in a predetermined amount of time.

Example 15 is a valve system comprising: a housing defining an inlet channel; a valve positionable and actuatable in a wellbore to control flow of fluid by being actuatable to a closed position adjacent to the inlet channel to prevent the flow of fluid in the wellbore; and a support in the valve to controllably override an actuation of the valve to allow the flow of the fluid while the valve is receiving a biasing force for closing the valve, the support being degradable to allow the valve to prevent flow of fluid in the wellbore after being biased into the closed position.

Example 16 is the valve system of example 15, wherein the support comprises a first material that is degradable after a predetermined amount of time in a presence of wellbore fluid, and wherein the first material comprises a dissolvable metal or a hydrolyzable polymer.

Example 17 is the valve system of example 15, wherein the valve has a top side and a bottom side, wherein a first force is appliable from the support to the top side of the valve to oppose a second force appliable to the bottom side of the valve and to retain the valve open for a predetermined amount of time, and wherein the second force is transmittable through a pilot line coupled with the valve system for applying the second force to the bottom side of the valve.

Example 18 is the valve system of example 15, wherein the support comprises a compression-based temporary support that is positionable between the valve and an interior wall of the valve system to retain the valve in an open orientation while the valve is being biased towards the closed position.

Example 19 is the valve system of example 15, wherein the support comprises a tension-based temporary support that is positionable around a valve seat of the valve to provide a tension-based force to override the valve to allow the flow of the fluid while the valve is being biased towards the closed position.

Example 20 is the valve system of example 15, wherein the valve comprises a piston actuatable between an open position and the closed position, wherein the housing comprises a piston seat opposing the piston, and wherein the support is positionable in the inlet channel to controllably override the valve to allow the flow of the fluid while the valve is being biased towards the closed position.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A valve system comprising:

a valve comprising a valve seat and defining an orifice, the valve positionable and actuatable in a wellbore to control flow of fluid by being actuatable to a closed position to prevent the flow of fluid in the wellbore; and a support in the valve to controllably override an actuation of the valve to allow the flow of the fluid while the valve is receiving a biasing force for closing the valve, the support being degradable to allow the valve to prevent flow of fluid in the wellbore after being biased into the closed position, the support located on a plane between the valve seat and the orifice, and the support extending from a first point on the valve seat to a second point that is between the orifice and the valve seat.

2. The valve system of claim 1, wherein the support comprises a first material that is degradable after a predetermined amount of time in a presence of wellbore fluid, and wherein the first material comprises a dissolvable metal or a hydrolyzable polymer.

3. The valve system of claim 1, wherein the valve has a top side and a bottom side, and wherein a first force is appliable from the support to the top side of the valve to oppose a second force appliable to the bottom side of the valve and to retain the valve open for a predetermined amount of time.

4. The valve system of claim 3, wherein the second force is transmittable through a pilot line coupled with the valve system for applying the second force to the bottom side of the valve, wherein the second force is a pressure applicable as the biasing force.

5. The valve system of claim 1, wherein the support comprises a compression-based temporary support that is positionable between the valve and an interior wall of the valve system to retain the valve in an open orientation while the valve is being biased towards the closed position.

6. The valve system of claim 1, wherein the support comprises a tension-based temporary support that is positionable around the valve seat to provide a tension-based force to override the valve to allow the flow of the fluid while the valve is being biased towards the closed position.

7. The valve system of claim 1, wherein the valve comprises:

a piston actuatable between an open position and the closed position, and a housing comprising a piston seat opposing the piston and defining an inlet channel for directing the fluid into or out of the valve system; and wherein the support is positionable in the inlet channel to controllably override the valve to allow the flow of the fluid while the valve is being biased towards the closed position.

8. A method comprising:

providing a valve system in a wellbore, the valve system comprising a valve and a support coupled with the valve, the valve comprising a valve seat and defining an orifice, the support located on a plane between the valve seat and the orifice, and the support extending from a first point on the valve seat to a second point that is between the orifice and the valve seat;

facilitating flow of fluid with respect to the wellbore using the valve system, the support overriding one or more biasing forces for closing the valve to allow the flow of fluid; and degrading the support to allow the valve system to close in response to receiving one or more subsequent biasing forces.

9. The method of claim 8, wherein the support comprises a first material that comprises a dissolvable metal or a hydrolyzable polymer, and wherein degrading the support comprises degrading the first material after a predetermined amount of time in a presence of wellbore fluid.

10. The method of claim 8, wherein the valve has a top side and a bottom side, and wherein facilitating the flow of the fluid comprises applying first force from the support to the top side of the valve to oppose a second force applied to the bottom side of the valve and to retain the valve open for a predetermined amount of time.

11. The method of claim 10, wherein facilitating the flow of the fluid comprises transmitting the second force through a pilot line coupled with the valve system for applying the second force to the bottom side of the valve.

12. The method of claim 8, wherein the support comprises a compression-based temporary support that is positioned between the valve and an interior wall of the valve system, and wherein facilitating the flow of fluid comprises using the compression-based temporary support to retain the valve in an open orientation while the valve is being biased towards a closed position.

13. The method of claim 8, wherein the support comprises a tension-based temporary support that is positioned around the valve seat, and wherein facilitating the flow of the fluid comprises using the tension-based temporary support to provide a tension-based force to override the valve to allow the flow of the fluid while the valve is being biased towards a closed position.

14. The method of claim 8, wherein degrading the support comprises triggering a degradation process of the support by injecting wellbore fluid into the valve system to degrade the support in a predetermined amount of time.

15. A valve system comprising:

a housing defining an inlet channel;

a valve comprising a valve seat and defining an orifice, the valve positionable and actuatable in a wellbore to control flow of fluid by being actuatable to a closed position adjacent to the inlet channel to prevent the flow of fluid in the wellbore; and a support in the valve to controllably override an actuation of the valve to allow the flow of the fluid while the valve is receiving a biasing force for closing the valve, the support being degradable to allow the valve to prevent flow of fluid in the wellbore after being biased into the closed position, the support located on a plane between the valve seat and the orifice, and the support extending from a first point on the valve seat to a second point that is between the orifice and the valve seat.

16. The valve system of claim 15, wherein the support comprises a first material that is degradable after a predetermined amount of time in a presence of wellbore fluid, and wherein the first material comprises a dissolvable metal or a hydrolyzable polymer.

17. The valve system of claim 15, wherein the valve has a top side and a bottom side, wherein a first force is appliable from the support to the top side of the valve to oppose a second force appliable to the bottom side of the valve and to retain the valve open for a predetermined amount of time, and wherein the second force is transmittable through a pilot line coupled with the valve system for applying the second force to the bottom side of the valve.

18. The valve system of claim 15, wherein the support comprises a compression-based temporary support that is positionable between the valve and an interior wall of the valve system to retain the valve in an open orientation while the valve is being biased towards the closed position.

19. The valve system of claim 15, wherein the support comprises a tension-based temporary support that is positionable around the valve seat to provide a tension-based force to override the valve to allow the flow of the fluid while the valve is being biased towards the closed position.

20. The valve system of claim 15, wherein the valve comprises a piston actuatable between an open position and the closed position, wherein the housing comprises a piston seat opposing the piston, and wherein the support is positionable in the inlet channel to controllably override the valve to allow the flow of the fluid while the valve is being biased towards the closed position.

* * * * *